US005250975A

United States Patent [19]

Beckmann et al.

[11] Patent Number: 5,250,975

[45] Date of Patent: Oct. 5, 1993

[54] APPARATUS FOR SIMULTANEOUSLY PROCESSING PLURAL WEBS OF PHOTOSENSITIVE MATERIAL

[75] Inventors: Lutz Beckmann, Munich; Viktor Osegowitsch, Taufkirchen, both of Fed. Rep. of Germany

[73] Assignee: Agfa-Gevaert Aktiengesellschaft, Leverkusen, Fed. Rep. of Germany

[21] Appl. No.: 893,122

[22] Filed: Jun. 3, 1992

[30] Foreign Application Priority Data

Jul. 1, 1991 [DE] Fed. Rep. of Germany ..... 4121729

[51] Int. Cl.[5] ..... G03D 3/08

[52] U.S. Cl. ..... 354/321

[58] Field of Search ..... 354/319, 320, 322, 323, 354/324; 137/64 R, 64 P, 122 P, 122 R

[56] References Cited

U.S. PATENT DOCUMENTS 3,688,677 9/1972 Frick et al. ..... 134/122 P
3,873,988 3/1975 Pfeifer et al. ..... 354/319
3,988,756 10/1976 Wick et al. ..... 354/319

*Primary Examiner*—D. Rutledge
*Attorney, Agent, or Firm*—Peter K. Kontler

[57] ABSTRACT

Apparatus for simultaneously treating two or more webs of photosensitive material has a tank with sets of pulleys for advancement of discrete webs. The sets of pulleys are installed in discrete compartments which are separated from each other by one or more light-intercepting partitions having one or more passages for the flow of liquid but preventing the penetration of light. Each set of pulleys is driven by a discrete motor or by a discrete clutch receiving torque from a single prime mover. The compartments are sealed by discrete closures. If the parts which are used to advance and treat a particular web happen to be defective or require attention for any other reason, the respective set of pulleys is arrested while the other set or sets of pulleys continue to transport the respective web or webs, and the cover for the compartment which confines the arrested set of pulleys is removed to afford access to the respective compartment.

11 Claims, 1 Drawing Sheet

APPARATUS FOR SIMULTANEOUSLY PROCESSING PLURAL WEBS OF PHOTOSENSITIVE MATERIAL

BACKGROUND OF THE INVENTION

The invention relates to improvements in apparatus for processing webs or strips or photosensitive material in photographic processing laboratories and similar establishments.

The treatment of films in photographic processing laboratories is being automated to a progressively increasing extent in order to save labor and time and to thus reduce the cost of development, printing and other processing. A modern photographic processing laboratory operates in such a way that the exposed customer films are admitted at one end of a production line and the other end of the production line discharges exposed and developed photographic films (often cut up into sections each of which contains a relatively small number of film frames) and the corresponding prints on exposed and developed photographic paper. Such laboratory no longer relies on rolling up of exposed films between the inlet and the outlet of the production line, and this holds equally true for the manipulation of photographic paper. In other words, once a film has been admitted into a production line, it is caused to advance along a predetermined path without being convoluted onto the cores of reels, bobbins or like storing devices, and this also applies for the manipulation of webs of photographic paper which is to yield prints of exposed and developed film frames. Laboratories of the above outlined character are known as maxilabs. A person at the inlet of a production line inserts successive cartridges with exposed but undeveloped customer film, and the film is thereupon automatically withdrawn from the respective cassette, advanced through one or more monitoring stations, through a developing station and through a copying station. A large number of films can be spliced together end-to-end prior to entering the developing station. The treatment of photographic papers is automated to a similar extent. Such treatment involves developing of exposed photographic paper and subdivision of developed paper into discrete prints. A person at the outlet of the production line introduces the exposed photographic films and the corresponding prints into the pockets of envelopes which are thereupon shipped to or picked up by dealers or customers.

In order to achieve additional savings in space and equipment, it was already proposed to assemble two or more maxilabs in such a way that they operate in parallel and can employ common developing tanks, fixing tanks, rinsing tanks and/or other treating units. For example, each tank for the development of films or photographic paper can be designed to permit the establishment of paths for two or more webs of photosensitive material.

A drawback of heretofore known combined maxilabs wherein at least one treating unit is common to a plurality of running webs of photosensitive material is that the entire production line must be shut down if the equipment for the treatment of a single web happens to be defective or requires attention of a nature which necessitates stoppage of the transporting system for the respective web. This entails considerable losses in output because any stoppage of a single web necessitates simultaneous stoppage of each other web.

OBJECTS OF THE INVENTION

An object of the invention is to provide an apparatus for simultaneous treatment of two or more running webs of photosensitive material which is constructed and assembled in such a way that temporary stoppage of facilities for the treatment of a particular web does not necessitate simultaneous stoppage of facilities for the treatment of the other web or webs.

Another object of the invention is to provide a combination of maxilabs wherein defective operation of one maxilab does not necessitate even temporary stoppage of the other maxilab or maxilabs.

A further object of the invention is to provide a novel and improved web treating unit for use in the above outlined apparatus.

An additional object of the invention is to provide a novel and improved liquid confining tank for use in the above outlined apparatus.

Still another object of the invention is to enhance the output of a production line which employs two or more maxilabs.

A further object of the invention is to provide a novel and improved method of enhancing the output of a combination of two or more maxilabs in a photographic processing laboratory.

An additional object of the invention is to provide a novel and improved developing unit for plural webs of photographic paper or other photosensitive material.

Another object of the invention is to provide novel and improved means for operating the drives for plural webs in an apparatus which employs two or more maxilabs.

A further object of the invention is to provide a photographic processing laboratory which employs one or more apparatus of the above outlined character.

An additional object of the invention is to reduce the cost of photographic prints and the cost of development of exposed photographic films.

Another object of the invention is to provide an apparatus which can employ numerous standard parts of the type used in heretofore known apparatus for the development and other processing of exposed photographic films in processing laboratories.

SUMMARY OF THE INVENTION

The invention is embodied in an apparatus for simultaneously processing a plurality of discrete webs of photosensitive material, such as webs of exposed photographic film or webs of exposed photographic paper. The improved apparatus comprises at least one treating unit, a plurality of transporting devices, one for each web and each defining a discrete path for advancement of the respective web through the at least one treating unit, and means for operating the transporting devices including a discrete drive for each transporting device so that each transporting device can advance the respective web independently of each other web.

In accordance with one presently preferred embodiment of the invention, each drive comprises a discrete prime mover. Alternatively, the operating means can further comprise a single prime mover and each drive then comprises means for coupling the prime mover with, and for uncoupling the prime mover from, the respective transporting device.

The at least one treating unit can comprise a liquid confining tank and each transporting device can include at least one rotary web advancing member, particularly a pulley which is arranged to receive motion from the respective drive.

The at least one treating unit can further comprise means for sealing the paths from each other against penetration of light. Such sealing means can comprise a discrete partition between each pair of discrete compartments for the paths, and the tank can further comprise a discrete light-intercepting closure for each compartment.

The at least one treating unit can further comprise means for communicatively connecting the compartments to each other so that the confined liquid (e.g., a developing, fixing or rinsing bath for photosensitive material) is free to flow between discrete compartments in the tank. Such compartments can include neighboring first and second compartments, and the at least one treating unit can further comprise a single liquid circulating unit which defines for the liquid an endless path extending from the circulating unit through the first compartment, through the connecting means in the partition between the first and second compartments, through the second compartment, and back to the circulating unit.

The connecting means can comprise at least one labyrinthine passage which is defined by the sealing means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
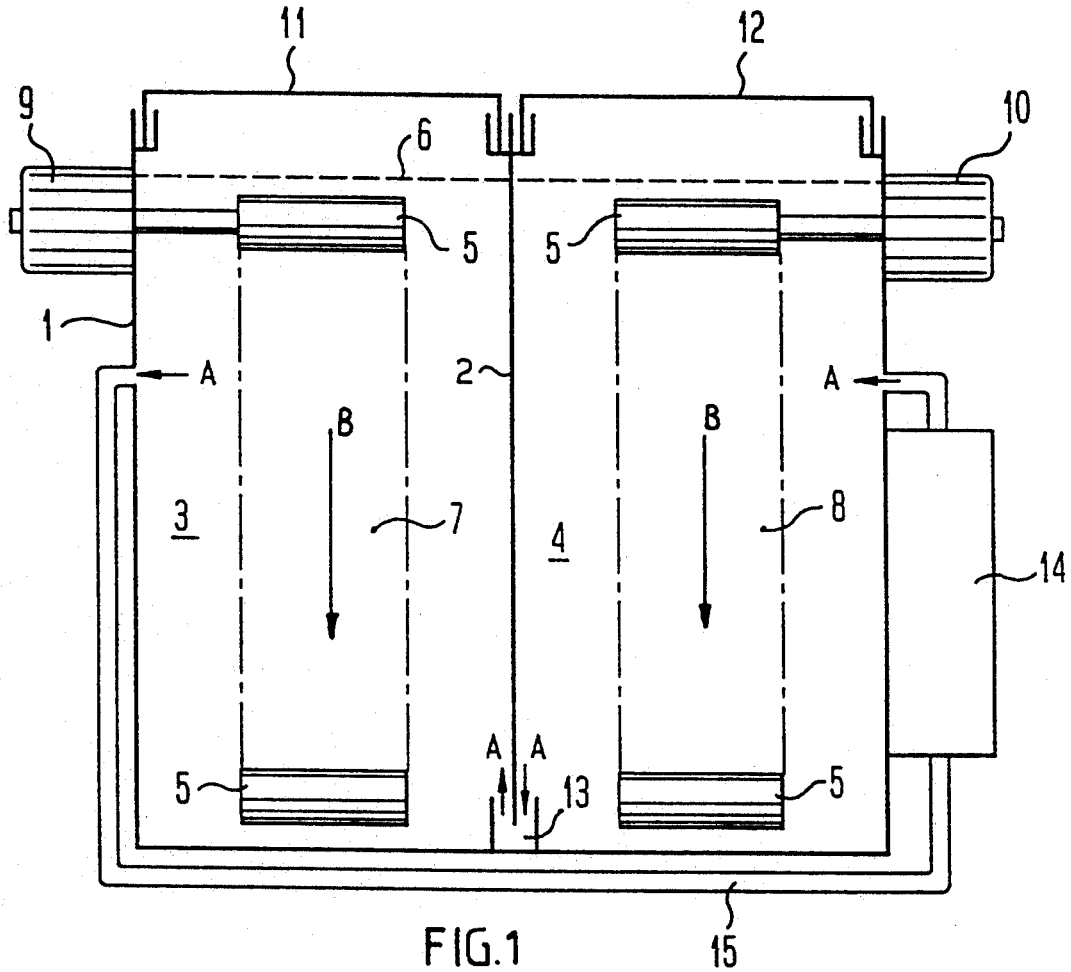
FIG. 1 is a schematic vertical sectional view of a portion of an apparatus which embodies one form of the invention and wherein each drive comprises a discrete prime mover.

FIG. 1 shows a portion of an apparatus which embodies a first form of the present invention. The apparatus is designed to simultaneously process several webs 7, 8 of photosensitive material, e.g., webs of exposed photographic film or webs of exposed photographic paper. The apparatus comprises at least one treating unit which includes a developing, fixing or rinsing tank 1 having a plurality of lighttightly sealed chambers or compartments 3, 4, one for each web of photosensitive material. The sealing means between the illustrated compartments 3, 4 in the tank 1 comprises an upright partition 2, and each of these compartments can be sealed from above against penetration of light by a discrete closure or lid 11, 12, respectively.

The apparatus further comprises a discrete transporting device for each web, and each of the illustrated transporting devices comprises a plurality of rotary web advancing members in the form of pulleys 5 which are installed in the respective compartments 3, 4 of the tank 1 below the level 6 of the top surface of the confined liquid bath and can be rotated to advance the respective webs 7, 8 in directions indicated by arrows B.

In accordance with the first embodiment, the means for operating the transporting devices including the pulleys 5 comprises a discrete drive for each transporting device, and each such drive comprises a discrete electric or other suitable motor 9, 10 which can be started and arrested independently of the other motor, i.e., the web 7 can be caused to advance along its path through the body of liquid in the tank 1 independently of the web 8 and vice versa.

The bottom portion of the illustrated sealing means or partition 2 includes a labyrinthine passage 13 serving as a means for communicatively connecting the compartments 3, 4 to each other so that the confined liquid can flow from the compartment 3 into the compartment 4 or in the opposite direction but light which has been permitted to enter one of these compartments is prevented from entering the other compartment as long as the closure for the other compartment remains in the illustrated sealing position. The partition 2 can be provided with two or more labyrinthine passages 13 and/or analogous passages which permit the flow of a liquid but prevent the penetration of light.

An advantage of the passage or passages 13 is that the treating unit including the tank 1 can be provided with a single combined circulating, regenerating and tempering unit 14 for the liquid. Such single unit 14 can include one or more pumps (not specifically shown) serving to circulate the liquid along an endless path extending from the outlet of the unit 14, through the compartment 4, through the passage or passages 13 in the partition 2 and the compartment 3, and through a return conduit 15 to the inlet of the unit 14. The direction of circulation of the liquid is indicated by arrows A.

If the motor 9 and/or the pulleys 5 of the transporting device in the compartment 3 and/or the means for supplying the web 7 into the compartment 3 and/or the means for receiving the web 7 from the tank 1 fails to operate in the desired manner, the operator in charge or an automatic control unit arrests the motor 9 so that the cover 11 can be lifted off the left-hand portion of the tank 1 while the cover 12 remains in the illustrated position and the motor 10 continues to drive the pulleys 5 in the compartment 4 so that the treatment of the web 8 continues without any interruptions. Analogously, the motor 9 can continue to drive the pulleys 5 in the compartment 3 if any part of the apparatus which is used to advance and/or otherwise treat the web 8 happens to be out of commission. The same holds true if the apparatus includes a tank with three or more compartments or a multiple-section tank for simultaneous treatment of three or more webs of photosensitive material. Each of the webs can consist of a series of successive separate or interconnected web portions. If the apparatus comprises one or more tanks with pulleys and/or other transporting devices which provide discrete paths for three or more webs, the operating means for the drives comprises a discrete prime mover for each transporting device, i.e., for each web.

An important advantage of the improved apparatus is that the output of the apparatus need not be reduced to zero when the apparatus can properly transport and treat one or more webs but the parts which advance and/or treat a further web require attention of a nature which requires stoppage of the respective drive and/or lifting of the respective cover.

The passage or passages 13 and the single circulating, regenerating and tempering unit 14 constitute an optional but desirable and advantageous feature of the improved apparatus. An advantage of such single unit 14 is that the improved apparatus is much simpler and less expensive than two conventional treating apparatus each of which is designed to treat a single web of photosensitive material.

The illustrated tank 1 can constitute one of a series of two or more successive liquid-confining tanks. Stoppage of the motor 9 or 10 results in stoppage of the corresponding portion of the web 7 or 8 in each of two or more successive tanks.

Figure 2:
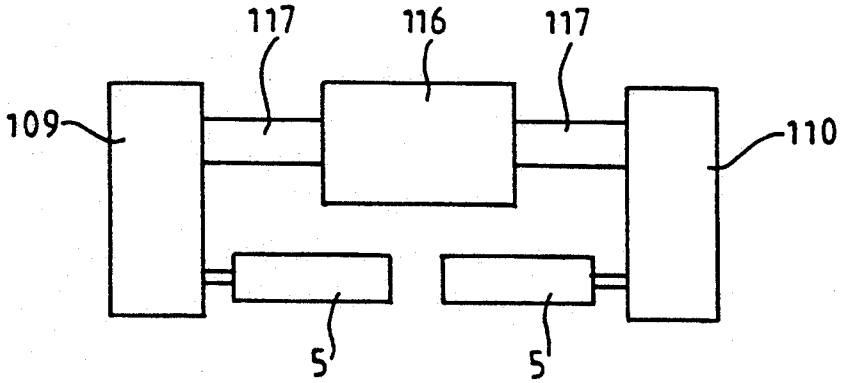
FIG. 2 illustrates a portion of a second apparatus wherein the operating means comprises a single prime mover and discrete clutches which can couple the prime mover to, or disengage the prime mover from, the transporting devices for discrete webs of photosensitive material.

FIG. 2 shows a portion of a second apparatus wherein the means for operating the transporting devices including the pulleys 5 includes a single prime mover 116 (e.g., a variable-speed electric motor or another suitable motor) and the discrete drives for the individual transporting devices comprise clutches 109, 110 serving as a means for releasably coupling the output element 17 of the prime mover 116 to the respective sets of pulleys 5. In all other respects, the apparatus which embodies the structure of FIG. 2 is or can be identical with the apparatus of FIG. 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus for simultaneously processing a plurality of discrete webs of photosensitive material, comprising at least one treating unit; a plurality of transporting devices, one for each web and each defining a discrete path for advancement of the respective web through said at least one treating unit, said at least one treating unit comprising a liquid confining tank and means for sealing said paths from each other against penetration of light, said tank including a discrete compartment for each of said paths and a discrete light intercepting closure for each of said compartments; and means for operating said transporting devices including a discrete drive for each of said transporting devices so that each of said transporting devices can advance the respective web independently of each other web.

2. The apparatus of claim 1, wherein each of said drives comprises a discrete prime mover.

3. The apparatus of claim 1, wherein said operating means further comprises a prime mover and each of said drives comprises means for coupling said prime mover with, and for uncoupling said prime mover from, the respective transporting device.

4. The apparatus of claim 1, wherein each of said transporting devices includes at least one rotary web advancing member.

5. The apparatus of claim 1, wherein said tank includes a discrete compartment for each of said paths and said at least one treating unit further comprises means for communicatively connecting said compartments to each other so that the confined liquid is free to flow between said compartments.

6. Apparatus for simultaneously processing a plurality of discrete webs of photosensitive material, comprising at least one treating unit; a plurality of transporting devices, one for each web and each defining a discrete path for advancement of the respective web through said at least one treating unit, said at least one treating unit comprising a liquid confining tank and means for sealing said paths from each other against penetration of light, said paths including a first and a second path and said sealing means comprising a light-intercepting partition between said first and second paths; and means for operating said transporting devices including a discrete drive for each of said transporting devices so that each of said transporting devices can advance the respective web independently of each other web.

7. Apparatus for simultaneously processing a plurality of discrete webs of photosensitive material, comprising at least one treating unit; a plurality of transporting devices, one for each web and each defining a discrete path for advancement of the respective web through said at least one treating unit, said at least one treating unit comprising a liquid confining tank and means for sealing said paths from each other against penetration of light, said tank including a discrete compartment for each of said paths and said at least one treating unit further comprising means for communicatively connecting said compartments to each other so that the confined liquid is free to flow between said compartments, said compartments including a first and a second compartment and said at least one treating unit further comprising a single liquid circulating unit defining for the liquid an endless path extending from said circulating unit through said first compartment, through said connecting means, through said second compartment and back to said circulating unit; and means for operating said transporting devices including a discrete drive for each of said transporting devices so that each of said transporting devices can advance the respective web independently of each other web.

8. The apparatus of claim 7, wherein said single circulating unit comprises means for tempering the liquid.

9. Apparatus for simultaneously processing a plurality of discrete webs of photosensitive material, comprising at least one treating unit; a plurality of transporting devices, one for each web and each defining a discrete path for advancement of the respective web through said at least one treating unit, said at least one treating unit comprising a liquid confining tank and means for sealing said paths from each other against penetration of light, said tank including a discrete compartment for each of said paths and said at least one treating unit further comprising means for communicatively connecting said compartments to each other so that the confined liquid is free to flow between said compartments, said connecting means comprising at least one labyrinthine passage which is defined by said sealing means; and means for operating said transporting devices including a discrete drive for each of said transporting devices so that each of said transporting devices can advance the respective web independently of each other web.

10. Apparatus for simultaneously processing a plurality of discrete webs of photosensitive material, comprising at least one treating unit; a plurality of transporting devices, one for each web and each defining a discrete path for advancement of the respective web through said at least one treating unit, said at least one treating unit comprising a liquid confining tank and means for sealing said paths from each other against penetration of light, the liquid in said tank being a developing, fixing or rinsing liquid; and means for operating said transporting devices including a discrete drive for each of said transporting devices so that each of said transporting devices can advance the respective web independently of each other web.

11. Apparatus for simultaneously processing a plurality of discrete webs of photosensitive material, comprising at least one treating unit; a plurality of transporting devices, one for each web and each defining a discrete path for advancement of the respective web through said at lest one treating unit; and means for operating said transporting devices including a discrete drive for each of said transporting devices so that each of said transporting devices can advance the respective web independently of each other web, at least one of said transporting devices comprising at least one rotary pulley arranged to receive motion from the respective drive.

* * * * *